US007482944B2

(12) United States Patent
Bresin

(10) Patent No.: US 7,482,944 B2
(45) Date of Patent: Jan. 27, 2009

(54) METHOD AND DEVICE FOR RECEIVING SEQUENTIAL INSTRUCTIONS

(75) Inventor: Giovanni Bresin, Palo Alto, CA (US)

(73) Assignee: LSI Corporation, Milpitas, CA (US)

( * ) Notice: Subject to any disclaimer, the term of this patent is extended or adjusted under 35 U.S.C. 154(b) by 1662 days.

(21) Appl. No.: 10/124,040

(22) Filed: Apr. 17, 2002

(65) Prior Publication Data

US 2003/0197624 A1 Oct. 23, 2003

(51) Int. Cl.
*G08C 19/00* (2006.01)
*G08B 3/00* (2006.01)
*G10K 1/00* (2006.01)

(52) U.S. Cl. ..... 340/825.57; 340/825.69; 340/825.72; 340/309.4; 340/825.22; 340/3.71

(58) Field of Classification Search ..... 340/825.57, 340/825.69, 825.72, 309.4, 309.16, 825.22, 340/3.71; 341/176; 348/734, 706, 111–112
See application file for complete search history.

(56) References Cited

U.S. PATENT DOCUMENTS 4,325,081 A * 4/1982 Abe et al. ..... 386/83
4,866,542 A * 9/1989 Shimada et al. ..... 386/69
5,187,469 A * 2/1993 Evans et al. ..... 340/825.22
5,412,377 A * 5/1995 Evans et al. ..... 340/825.22
5,677,664 A * 10/1997 Sawinski ..... 340/426.12
5,835,665 A * 11/1998 Grossmeyer ..... 386/83

* cited by examiner

*Primary Examiner*—Brian A Zimmerman
*Assistant Examiner*—Nam V Nguyen
(74) *Attorney, Agent, or Firm*—Christopher P. Maiorana, PC

(57) ABSTRACT

A method of receiving a plurality of instructions. The method generally comprises the steps of (A) storing a first of the instructions in response to receiving the first instruction at an initial time, and (B) rejecting a second of the instructions that depends from the first instruction in response to receiving the second instruction greater than a maximum delay after the initial time.

19 Claims, 8 Drawing Sheets

METHOD AND DEVICE FOR RECEIVING SEQUENTIAL INSTRUCTIONS

FIELD OF THE INVENTION

The present invention relates to a method and/or architecture for receiving sequential instructions generally and, more particularly, to rejecting instructions with improper timing relative to an initial instruction.

BACKGROUND OF THE INVENTION

Infrared (IR) remote control devices are commonly used to transmit instructions to receivers in consumer electronics such as televisions, radios, cameras, video cassette recorders, and digital versatile disc (DVD) players. The IR remote control devices use infrared light pulses to transmit instructions to the receiver in accordance with a standard protocol. According to an NEC Corporation standard protocol, when a key of the remote control is pressed and held for a while, a set of pulses indicating a repeat key instruction (i.e., REP_KEY) is sent after a train of pulses that carries coded information for an instruction (i.e., KEY_A) of the key being pressed. The receiver interprets the repeat key instruction REP_KEY by repeating a most recently received non-repeat key instruction. For example, reception of the instruction KEY_A followed by three repeat key instructions REP_KEY will be interpreted as a sequence of four instructions KEY_A.

The above interpretation does not always produce a desired result for both a user and a maker of the consumer electronics. Situations commonly occur where the receiver accepts the instruction key KEY_A, misses a new instruction (i.e., KEY_B) and then receives a subsequent string of repeat key instructions REP_KEY intended for the new instruction KEY_B. As a result, the instruction KEY_A will be repeated because the instruction KEY_A was the most recently accepted instruction. Many factors can cause the new instruction KEY_B to be missed. Such factors include distance from the remote control, an object that shields the remote control from the receiver, and misalignment of the remote control and the receiver.

It is also desirable for a rate of repeating to vary for different keys. For example, a volume instruction and a string of repeat key instructions REP_KEY will be transmitted and received at a fixed rate when the user presses and holds a volume-up key. When the user presses and holds a television channel increment key, a channel increment instruction and another string of repeat key instructions REP_KEY will be transmitted and received at the same fixed rate. However, the manufacturer and the user commonly want the volume to increase at a slow rate for fine control and the television channel to increment quickly for rapid scrolling. With the fixed repeat rate for all repeat key instructions REP_KEY, the volume and channel change at the same rate.

Some remote control keys should not be repeated if pressed and held. In particular, numeric keys used to directly entered a desired television channel must not be repeated to avoid accidental selections of channels 11, 22, 33 and so on. The remote control, though, will transmit the repeat key instruction REP_KEY as long as a numeric key is pressed to comply with the protocol. Experience has shown that it is quite easy for users to cause unwanted repeat key instructions.

SUMMARY OF THE INVENTION

The present invention concerns a method of receiving a plurality of instructions. The method generally comprises the steps of (A) storing a first of the instructions in response to receiving the first instruction at an initial time, and (B) rejecting a second of the instructions that depends from the first instruction in response to receiving the second instruction greater than a maximum delay after the initial time.

The objects, features and advantages of the present invention include providing a method and/or architecture for receiving sequential instructions that may (i) discard false repeat instructions, (ii) disable acceptance of repeat instructions for predetermined key presses, (iii) provide for variable periods to consider a repeat instruction valid, (iv) vary an expected time when a new repeat instruction will be received, and/or (v) dynamically update repeat key characteristics at run time.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

Figure 1:
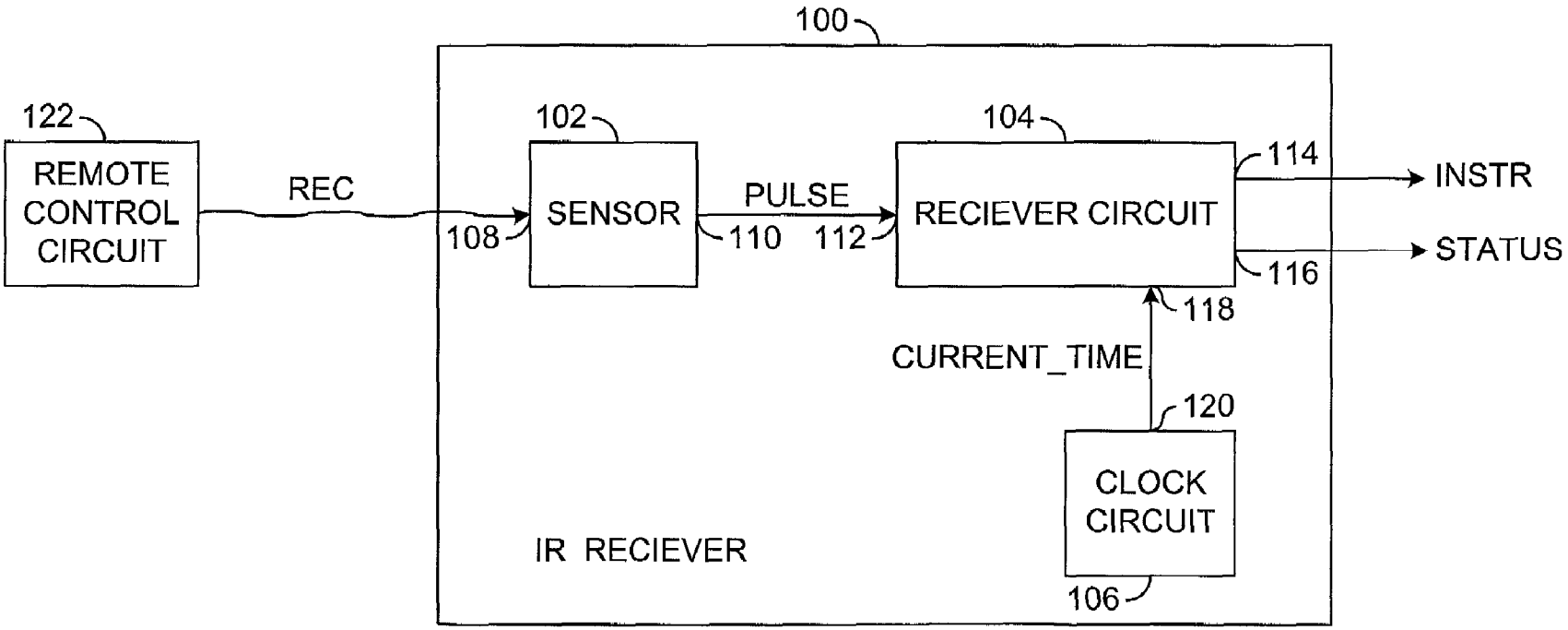
FIG. 1 is a block diagram of a device implementing a preferred embodiment of the present invention.

Referring to FIG. 1, a block diagram of device 100 is shown in accordance with a preferred embodiment of the present invention. The device 100 may be implemented as an infrared (IR) remote control receiver configured to receive a signal (e.g., REC). The device 100 generally comprises a sensor 102, a receiver circuit 104 and a clock circuit 106.

The sensor 102 may have an input 108 to receive the signal REC. An output 110 of the sensor 102 may be coupled to an input 112 of the receiver circuit 104 to transfer a signal (e.g., PULSE). The receiver circuit 104 may have an output 114 to present a signal (e.g., INSTR). The receiver 104 may have another output 116 to present another signal (e.g., STATUS). An input 118 of the receiver circuit 104 may be coupled to an output 120 of the clock circuit 106 to receive a signal (e.g., CURRENT_TIME).

The signal REC may be implemented as an optical signal. In one embodiment, the optical signal REC may be implemented as an infrared (IR) optical signal. The optical signal REC may transfer codes or instructions from a remote control 122 to the device 100. The instructions may provide parameters for the operation of the device 100. The instructions may be pulse encoded within the optical signal REC. The optical signal REC may be implemented as other types of signals, for example radio-frequency, acoustic and electrical, to meet the design criteria of a particular application.

The signal PULSE may be implemented as an electrical signal. The electrical signal PULSE may be an electrical version of the optical signal REC. The electrical signal PULSE may transfer the same instruction carried by the optical signal REC. The instructions may be pulse encoded within the electrical signal PULSE.

The signal INSTR may be implemented as a decoded instruction signal. The signal INSTR may carry the instructions decoded from the signal PULSE. A unique value may be used to identify each type of instruction presented by the signal INSTR.

The signal STATUS may be implemented as a status signal. The signal STATUS may provide additional information about the signal INSTR. A valid state may be provided in the signal STATUS while the signal INSTR contains a valid or accepted instruction. An invalid state may be provided in the signal STATUS while the signal INSTR contains an invalid or rejected instruction. In one embodiment, the invalid state information may be presented in the signal INSTR as a special code while all other codes are presumed to be valid. In another embodiment, the signal INSTR may be suppressed by the receiver circuit 104 while the signal STATUS simultaneously conveys the invalid state.

The signal CURRENT_TIME may be implemented as a time signal. The signal CURRENT_TIME may provide a time value to the receiver circuit 104 that updates on a periodic basis. The length of a period is generally less than a time duration for receiving an instruction within the signal REC.

The sensor 102 may be operational to convert the signal REC to the signal PULSE. Different types of sensors 102 may be implemented to match the type (e.g., optical, radio-frequency, etc.) of signal REC. The receiver circuit 104 may be operational to accept or reject instructions within the signal PULSE based upon (i) the type of instruction received, (ii) a previously received instructions, (iii) a time of reception as determined by the signal CURRENT_TIME, and/or (iv) a value of a disable signal allocated to each type of instruction. The clock circuit 106 may be configured to generate the signal CURRENT_TIME.

The instructions conveyed by the signals REC, PULSE and INSTR may be generally categorized as repeat instructions and non-repeat instructions. A unique non-repeat instruction is generally generated and transmitted by the remove control 122 for each key press detected by the remote control 122. Examples of non-repeat instructions may include, but are not limited to, volume increase, volume decrease, channel increase, channel decrease, 0, 1, 2, 3, 4, 5, 6, 7, 8, 9, 0, play, stop, fast forward, reverse, pause, record and the like. Repeat instructions generally depend on a previously received non-repeat instruction. One or more repeat instructions may follow any non-repeat instruction while a selected key of the remote control circuit 122 remains pressed. The device 100 may interpret each received repeat instruction as if a duplicate of a last received non-repeat instruction had been received. For example, a volume increase instruction followed by five repeat instructions may be treated as six consecutive volume increase instructions.

Figure 2:
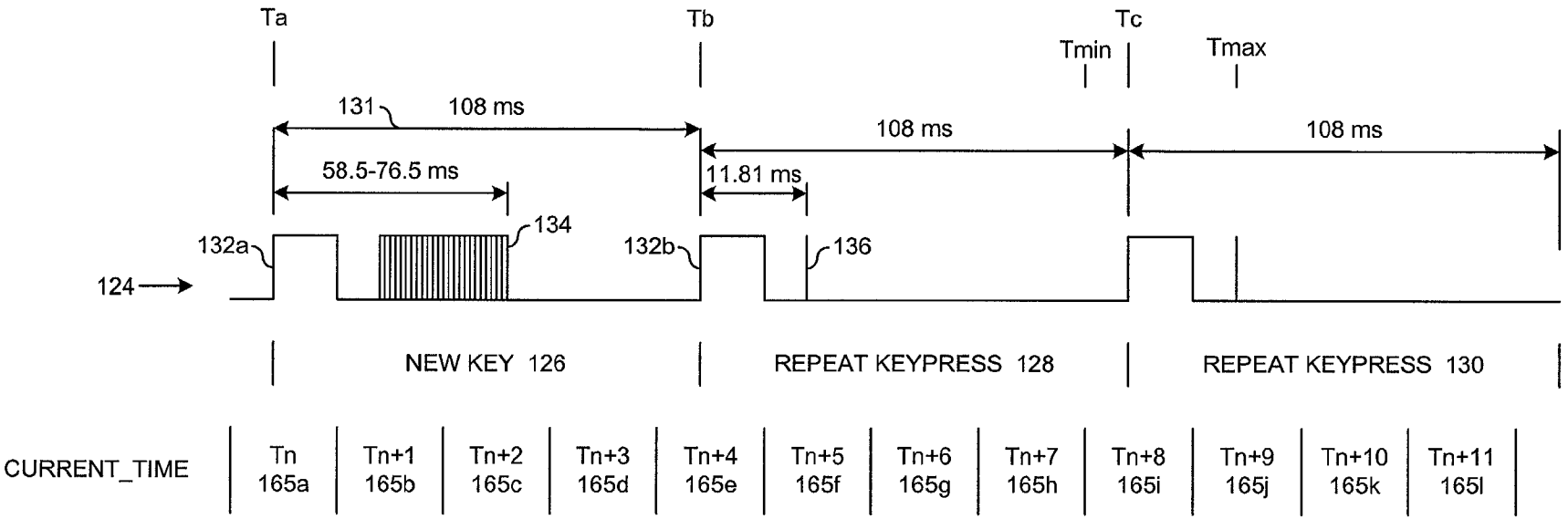
FIG. 2 is an example waveform of instructions.

Referring to FIG. 2, an example waveform 124 of the signal REC is shown. The waveform 124 generally comprises a non-repeat instruction (e.g., New Key 126) followed by two repeat instructions (e.g., Repeat Key press 128 and Repeat Key press 130).

Each instruction generally has a constant pulse period or frame period 131. For example, the frame period 131 may be approximately 108 milliseconds (ms) regardless of the type of instruction being transmitted. Sequential frames may be transmitted without an inter-frame gap. Therefore, a frame for the repeat key press 130 may be being at a known time (e.g., 216 ms) after a beginning of the frame for the new key 126. Other implementations of the waveform 124 may be provided to meet the design criteria of a particular application.

The new key 126 instruction generally comprises a leader code 132*a* followed by an information code 134. A combined duration of the leader code 132*a* and the information code 134 may vary in time depending on the instruction being send. For example, the combined duration may vary from approximately 58.5 ms to approximately 76.5 ms. The remainder of the frame period may be silent.

The repeat key press 128 instruction generally comprises a leader code 132*b* followed by a repeat code 136. A combined duration of the leader code 132*b* and the repeat code 136 may be a predetermined time. For example, the predetermined time may be approximately 11.81 ms. The remainder of the frame period may be silent. The repeat key press 130 instruction may be a copy of the repeat key press 128.

Figure 3:
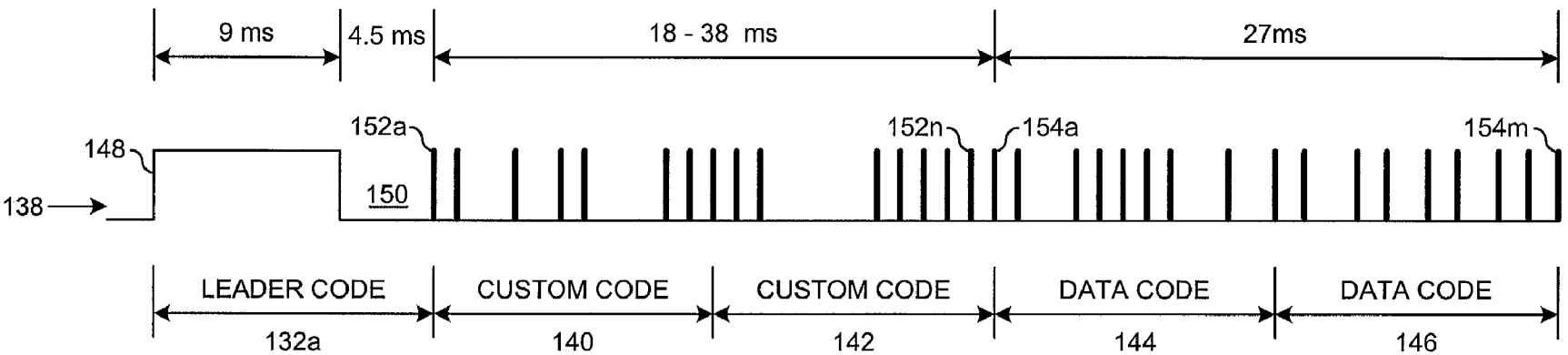
FIG. 3 is an example waveform of a non-repeat key

Referring to FIG. 3, a waveform 138 of a portion of the new key press 126 is shown. The waveform 138 generally comprises the leader code 132*a*, two custom codes 140 and 142, and two data codes 144 and 146. The leader code 132A may comprise a synchronization pulse 148 having a duration and a gap 150 having another duration. As an example, the duration of the synchronization pulse 148 may be approximately 9 ms and the duration of the gap 150 may be approximately 4.5 ms. The custom codes 140 and 142 combined generally comprise a series of code pulses 152*a-n*. The pulses 152*a-n* may occur over a time range, for example approximately 18-36 ms, depending upon the type of instruction. The data codes 144 and 146 combined generally comprise another series of the code pulses 154*a-m*. By way of example, the pulses 154*a-m* may occur over a time range of approximately 27 ms. Other types of waveforms 138 may be implemented for the non-repeat instructions to meet the design criteria of a particular application.

Figure 4:
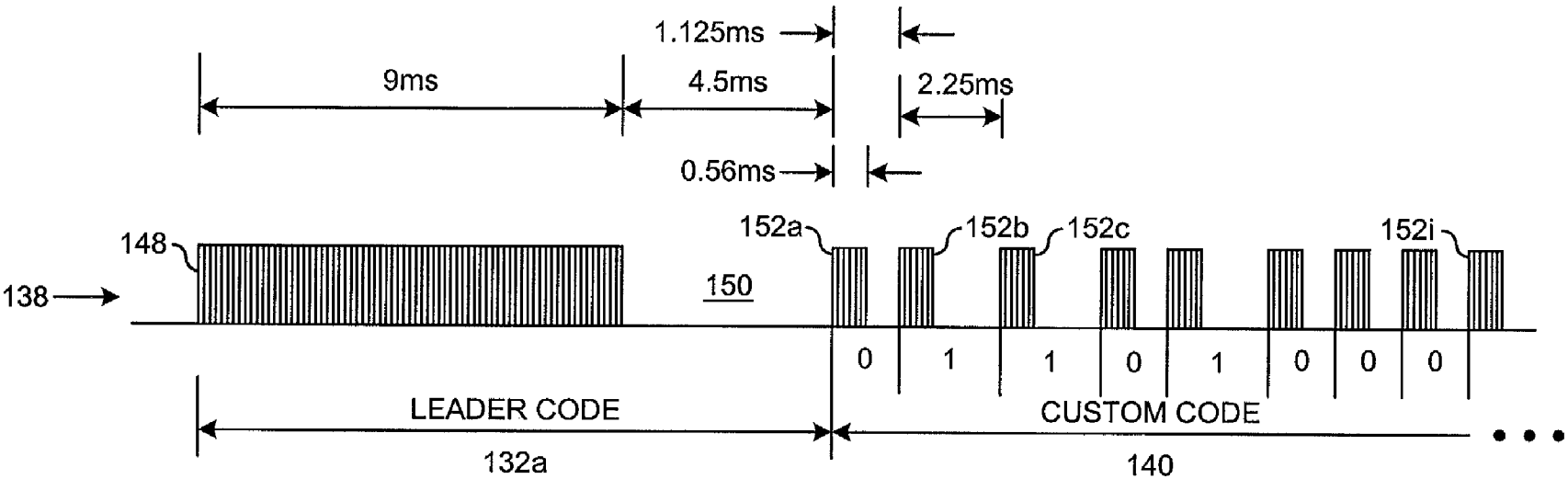
FIG. 4 is a detailed example waveform of a portion of the non-repeat key instruction.

Referring to FIG. 4, a detailed portion of the waveform 138 is shown. The custom code 140 may convey a sequence of logical ones (e.g., "1") and logical zeros (e.g., "0") based upon a pulse period modulation. For example, the code pulse 152*a* may define a beginning of a logical zero. In the code pulse 152*a* example, the logical zero may have a duration of approximately 1.125 ms from a start of a current code pulse (e.g., 152*a*) until a start of a subsequent code pulse (e.g., 152*b*). In contrast, the code pulse 152*b* may define a beginning of a logical one. For example, the logical one may have a period of approximately 2.25 ms from a start of a current code pulse (e.g., 152*b*) until a start of a subsequent code pulse (e.g., 152*c*). Each of the individual code pulses 152*a-n* (and 154*a-m*) may have a predetermined period. For example, each code pulse period may be approximately 0.56 ms.

Figure 5:
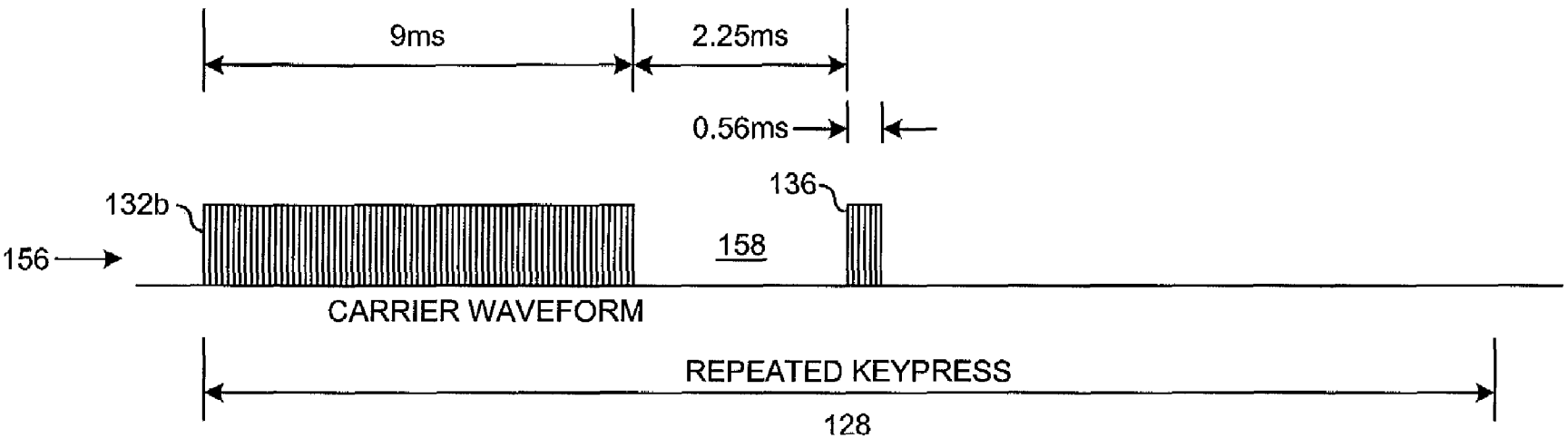
FIG. 5 is an example waveform of a repeat key

Referring to FIG. 5, a waveform 156 of the repeat key press 128 is shown. The repeat key press 128 generally comprises the leader code 132*b*, a gap 158 and a repeat code 136. The leader code 132*b* may have a fixed duration. For example, the fixed duration of the leader code 132*b* may be approximately 9 ms. The gap 158 may have another fixed duration. For example, the fixed duration of the gap 158 may be approximately 2.25 ms. The repeat pulse 136 may have another duration. For example, the duration of the repeat pulse 136 may be approximately 0.56 ms.

Figure 6:
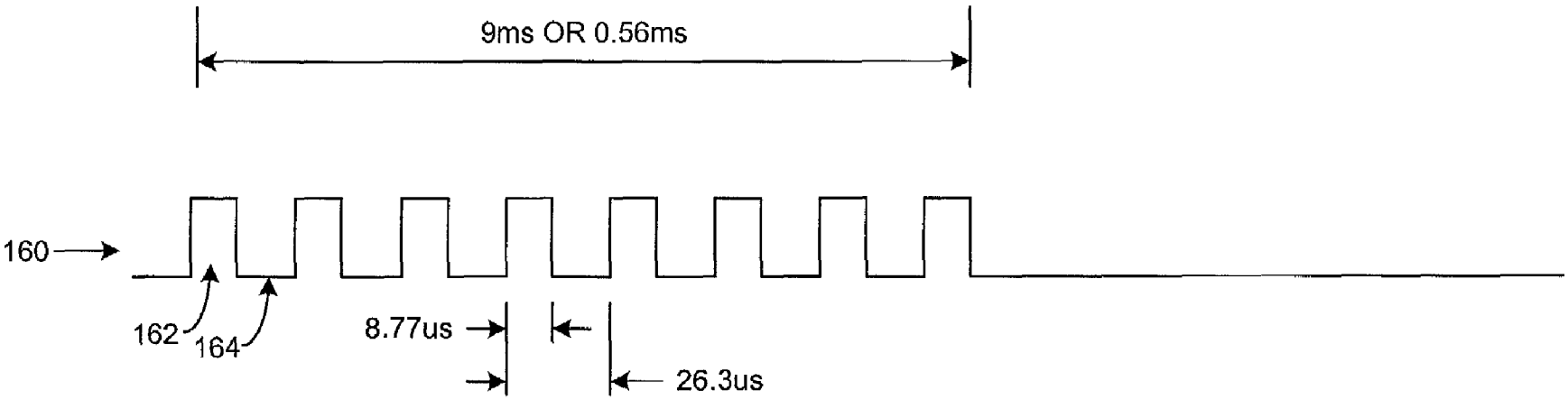
FIG. 6 is an example waveform of a carrier.

Referring to FIG. 6, a waveform 160 of a carrier is shown. The carrier may be used to build up the synchronization pulses, repeat pulses and code pulses. The carrier generally comprises a sequence of high symbols 162 separated by low symbols 162. Each high symbol 162 may have a predetermined duration or period. Each low symbol 164 may have another predetermined duration or period. For example, the predetermined duration of each high symbol 162 may be approximately 8.77 microseconds (us) and the predetermined duration of each low symbol 164 may be approximately 17.53 us for a total period of approximately 26.3 us. A string of high symbols 162 and low symbols 164 may span a range of time For example, the sting of high symbols 162 and low symbols 164 may range from approximately 0.56 ms to approximately 9 ms. The high symbols 162 may be implemented as a presence of photons. The low symbols 164 may be implemented as an absence at photons. Other types of symbols may be implemented to meet the design criteria of a particular application.

Referring again to FIG. 2, the signal CURRENT_TIME is shown with respect to the waveform 124. The signal CURRENT_TIME may quantize continuous time into finite periods 165*a-l*. Each of the finite periods Tx may have a predetermined period controlled by the clock generator 106. Each of the finite periods 165 may have a unique value (e.g., Tx, where x=n, n+1, n+2, . . . ). The values Tx may increment as time increases. The periods 165 may be non-synchronous or synchronous with the signals REC and PULSE. The periods 165 may be an integer or non-integer traction of the frame period 131.

The receiver circuit 104 may use the time Tx of the signal CURRENT_TIME to determine when the new key 126 instruction arrives (e.g., Ta). From the arrival time Ta, the receiver circuit 104 may determine a validity of the subsequent repeat key press 128 that may arrive at a later time (e.g., Tb).

For example, the arrival time Ta of the new key 126 instruction may be detected during the period 165*a* of the signal CURRENT_TIME. The receiver circuit 104 may use the value Tn of the period 165*a* to calculate a maximum delay in which a valid repeat key instruction may arrive. Likewise, the receiver circuit 104 may use the value Tn to calculate a minimum delay during which the valid repeat key instruction should not arrive. In one embodiment, the minimum delay and the maximum delay may be a beginning and an end respectively of a finite period 165. In other words, a difference between the minimum delay and the maximum delay may be one finite period 165. For example, the repeat key press 128 may only be considered valid if the arrival time Tb occurs anywhere within the period 165*e* at the time Tn+4.

Acceptance of the repeat key press 128 may cause the receiver circuit 104 to calculate a new expected arrival time for the repeat key press 130 based upon the arrival time of the repeat key press 128. The repeat key press 130 may be accepted upon arrival after a minimum delay and before a maximum delay after the time Tn+4. As before, the minimum delay (e.g., Tmin) and the maximum delay (e.g., Tmax) may be the beginning and end of a finite period or time, for example the time Tn+8.

Arrival of an instruction may be determined by any one or more features of the instruction. For example, the arrival time may be determined by (i) a start to the leader code 132, (ii) a valid completion of the synchronization pulse 148, (iii) a valid completion of the leader code 132, (iv) a subsequent pulse 152 or 136 and/or (v) completion of the pulse period 131. Other parameters may be used to define an arrival of an instruction to meet the design criteria of a particular application.

The receiver circuit 104 may be able to discard a programmable number of repeat key instructions before accepting a subsequent repeat key instruction. The ability to discard some repeat key instructions may allow the receiver circuit 104 to control a rate at which the prior non-repeat key instruction may be repeated. By way of example, the receiver circuit 104 may be programmed to discard the repeat key press 128 after acceptance of the new key press 126. Therefore, the receiver circuit 104 may accept the second repeat key press 130 if the repeat key press 130 arrives after a minimal delay and before a maximum delay from acceptance of the new key press 126. For example, the receiver circuit 104 may be programmed to accept a repeat key instruction that arrives a single discard period after the initial time Tn. As shown in FIG. 2, a discard period may be approximately four finite periods 165 long. Thus, the window to accept the second repeat key press 130 may anywhere during the finite time Tn+8.

The receiver circuit 104 may be programmable to ignore all repeat key instructions for certain new key instructions. The receiver circuit 104 may contain a signal (e.g., ENABLE_REP) for each type of new key instruction. Upon reception of each new key instruction, the receiver circuit 104 may check the signal ENABLE_REP, indexed for the received new key instruction, to determine if following repeat key instructions are to be accepted or rejected.

Figure 7:
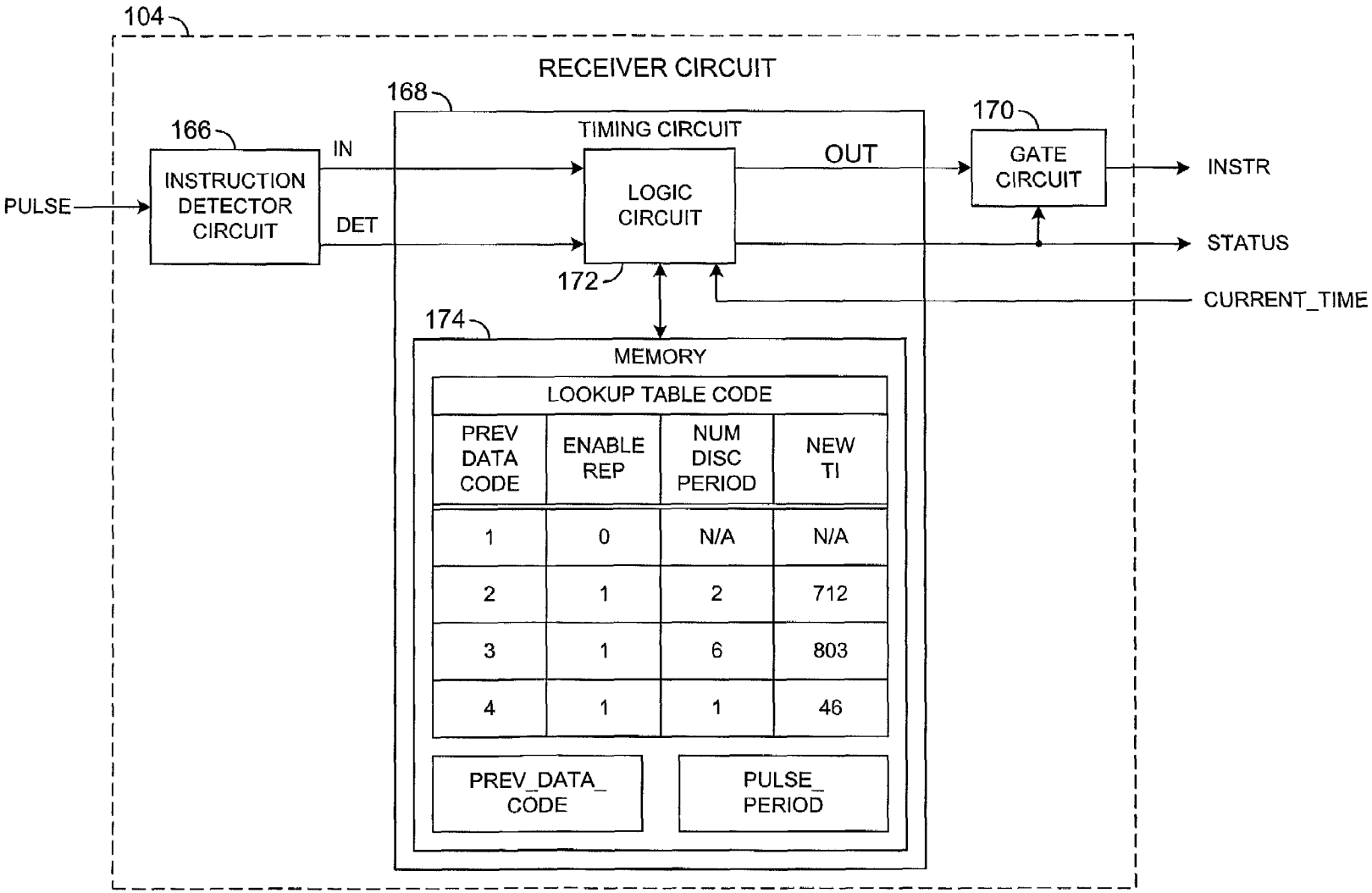
FIG. 7 is a detailed block diagram of a receiver circuit.

Referring to FIG. 7, a block diagram of the receiver circuit 104 is shown. The receiver circuit 104 generally comprises an instruction detector circuit 166, a timing circuit 168 and a gate circuit 170. The instruction detector circuit 166 may receive the signal PULSE from the sensor 102. The instruction detector circuit 166 may generate and present a signal (e.g., IN) to the timing circuit 168. The instruction detector circuit 166 may generate and present another signal (e.g., BET) to the timing circuit 168. The timing circuit 168 may generate and present a signal (e.g., OUT) to the gate circuit 170. The timing circuit 168 may also generate and present the signal STATUS external to the receiver circuit 104 and to the gate circuit 170. The timing circuit 168 may receive the signal CURRENT TIME from the clock circuit 106.

The signal IN may be implemented as an internal instruction input signal. The signal IN may carry the instructions received by the sensor 102 and detected by the instruction detector circuit 166. The signal DET may be implemented as a detection flag. The signal DET may identify when the signal IN contains a valid instruction or code. The signal OUT may be implemented as an internal instruction output signal. The signal OUT may convey a validly received key instruction. In one embodiment, the signal OUT may be suppressed by the gate circuit 170 when an improperly timed repeat key instruction has been received. In another embodiment, the signal OUT may convey an invalid value upon receipt of an illegal or improperly timed instruction. In still another embodiment, the timing circuit 168 may not present the signal OUT upon receipt of an illegal or improperly timed instruction.

The instruction detector circuit 166 may examine the signal PULSE to search for valid instructions. Upon receipt of a valid instruction, the instruction detector circuit 166 may present the valid instruction in the signal IN and set the signal DET to a valid state. Upon receipt of an invalid or partial instruction, the instruction detector circuit 166 may (i) suppress the invalid instruction or (ii) simultaneously present the invalid instruction in the signal IN and set the signal DET to an invalid state.

The timing circuit 168 may check for enabled repetition of the most recently received new key instruction. The timing circuit 168 may also check the timing of the repeat key instructions against the arrival time of the most recent new key instruction. The method implemented by the timing circuit 168 may be express by the following pseudo-code:

```
if (NEW_KEY)/
    {
    use new_key;
    /* store new key */
    PREV_DATA_CODE = NEW_KEY;
    /* store expected time of a repeat key instruction at NEW_T1
*/
    CODE [NEW_KEY] [NEW_T1] = CURRENT_TIME +
        CODE [PREV_DATA_CODE] [NUM_DISC_PERIOD] * PULSE_PERIOD;
    }
if (REP_KEY)
    {
/* Check for arrival time and enabled repetition */
if( (CURRENT_TIME == CODE [PREV_DATA_CODE] [NEW_T1]) &&
     CODE [PREV_DATA_CODE] [ENABLE_REP] )
    {
    /* repeat key instruction arrived in calculated window */
    use prev_data_code;
     CODE [PREV_DATA_CODE] [NEW_T1] = CURRENT_TIME +
        CODE [PREV_DATA_CODE] [NUM_DISC_PERIOD] * PULSE_PERIOD;
    }
else
/* repeat key instruction arrived outside calculated window */
do not update timing;
}
```

The gate circuit 170 may be optionally implemented to pass valid instructions and reject invalid instructions. The gate circuit 170 may pass the instructions in the signal OUT through to the signal INSTR while the signal STATUS has the valid state. The gate circuit 170 may suppress the instructions in the signal OUT while the signal STATUS has the invalid state.

The timing circuit 168 generally comprises a logic circuit 172 and a memory 174. The logic circuit 172 generally performs the operations of accepting or rejecting repeat key instructions based upon the signal ENABLE_REP and/or the arrival time. The logic circuit 172 may also store the most recently received non-repeat key instruction in the memory 174 and calculate the next valid arrival time of a repeat key instruction.

The memory 174 generally comprises a lookup table (e.g., CODE [y,x]), a variable (e.g., PREV_DATA_CODE) for the previously received non-repeat key instruction, and a variable (e.g., PULSE_PERIOD) for a duration of an instruction in units of the finite period 165. The parameter y of the lookup table CODE may provide an index for a particular non-repeat key instruction. The parameter x of the lookup table CODE may provide an index for the variables ENABLE_REP, NUM_DISC_PERIOD and NEW_T1.

The main idea is generally that once a new key instruction has been received (e.g., at a time Tx), a first repeat key instruction should be received as defined in equation 1 as follows:

$$NEW_T1=Tx+(NUM_DISC_PERIOD*PULSE\ PERIOD) \quad \text{Eq. (1)}$$

Reception of the repeat key instruction before or after the time NEW_T1 generally indicates that the repeat key instruction may not be related to the previously received new key instruction, so the repeat key instruction should not be executed. The clock circuit 106 may use operating system clock ticks as a way to keep track of the time passing from one reception to the other. The lookup table CODE may be set in the memory 174 together with the previously received valid data instruction. Another field may also be added in the lookup table CODE that, for each key instruction, may give a new data code value thus allowing a mapping of protocol defined keys to custom defined keys. The lookup table CODE may be loaded into the memory 174 permanently or at a run time for the timing circuit 168.

Figure 8:
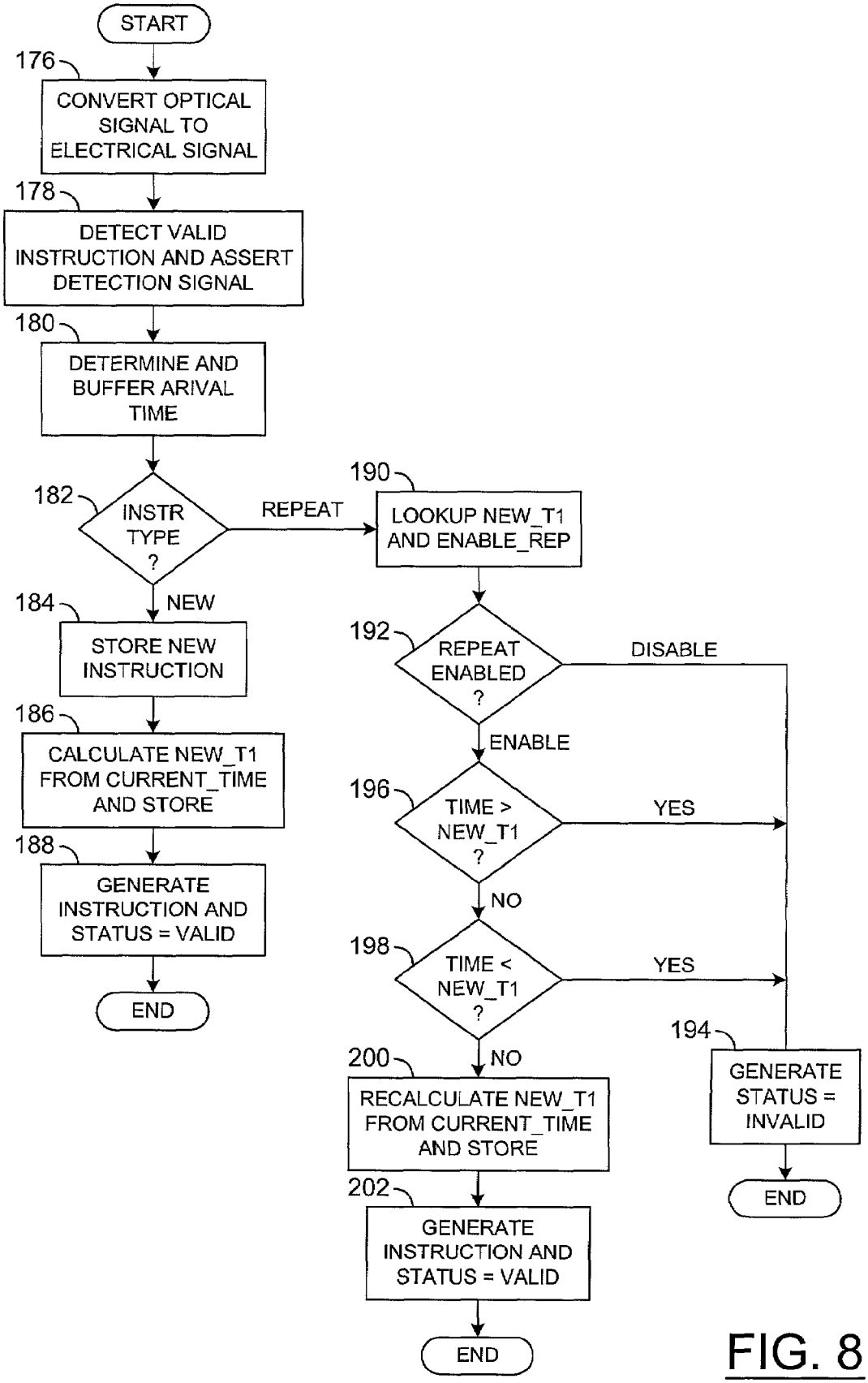
FIG. 8 is a flow diagram for a method of operation.

Referring to FIG. 8, a flow diagram for a method of operating the device 100 is shown. The method generally starts with a reception of the optical signal REC by the sensor 102 (e.g., block 176). The instruction detector circuit 166 may generate and present the signal IN with the appropriate instruction code received and assert the signal DET accordingly (e.g., block 178). The logic circuit 172 may determine and buffer the arrival time of the instruction as determined by the signal CURRENT_TIME (e.g., block 180). For a non-repeat key instruction type (e.g., the NEW branch from decision block 182)1 then logic circuit 172 may store the new instruction in the memory 174 as the variable PREV_DATA_CODE in place of a previous new instruction (e.g., block 184). The logic circuit 172 may then calculate and store (in the memory 174) the expected arrival time NEW_T1 of a repeat key instruction dependent on the new key instruction (e.g., block 186). The logic circuit 172 may generate (i) the signal INSTR and (ii) the signal STATUS in the valid state (e.g., block 188).

For a repeat key instruction (e.g., the REPEAT branch of decision block 182), the logic circuit 172 may read the expected arrival time NEW_T1 and the enable flag ENABLE_REP from the memory 174 (e.g., block 190). If the enable flag ENABLE_REP has a disabled state (e.g., the DISABLE branch of the decision block 192), the logic circuit 172 may generate and present the signal STATUS having the invalid state (e.g., block 194). If the signal ENABLE_REP has an enabled state (e.g., the ENABLE branch of decision block 192), the arrival time of the repeat key instruction may be checked (e.g., decision block 196). For an arrival time greater than the maximum delay (e.g., the YES branch of decision block 196), the logic block may generate the signal STATUS with the invalid state (e.g., block 194) as the repeat key instruction may have arrived too late.

For an arrival time less than or equal to the maximum delay (e.g., the NO branch of decision block 196), the arrival time may be compared against the minimum delay determined by the variables NUM_DISC_PERIOD and PULSE_PERIOD (e.g., decision block 198). For an arrival time less than the minimum delay (e.g., the YES branch of decision block 198), the logic circuit 172 may generate the signal STATUS with the invalid state (e.g., block 194) as the repeat key instruction may have arrived too early. For an arrival time greater than or equal to the minimum time (e.g., the NO branch of decision block 198), the logic circuit 172 may recalculate a next expected arrival time NEW_T1 based on the time CURRENT_TIME and store the expected arrival time NEW_T1 in the memory 174 (e.g., block 200). The logic circuit 172 may then generate (i) the signal INSTR and (ii) the signal STATUS with the valid state.

The various signals of the present invention are generally "on" (e.g., a digital HIGH, or 1) or "off" (e.g., a digital LOW, or 0). However, the particular polarities of the on (e.g., asserted) and off (e.g., de-asserted) states of the signals may be adjusted (e.g., reversed) accordingly to meet the design criteria of a particular implementation. Additionally, inverters may be added to change a particular polarity of the signals.

As used herein, the term "simultaneously" is meant to describe events that share some common time period but the term is not meant to be limited to events that begin at the same point in time, end at the same point in time, or have the same duration.

While the invention has been particularly shown and described with reference to the preferred embodiments thereof, it will be understood by those skilled in the art that various changes in form and details may be made without departing from the spirit and scope of the invention.

The invention claimed is:

1. A method of receiving a plurality of instructions, comprising the steps of:

(A) storing a first of said instructions in response to receiving said first instruction at an initial time;

(B) calculating a maximum delay as a predetermined multiplication factor times a period of said instructions; and (C) rejecting a second of said instructions that depends from said first instruction in response to receiving said second instruction greater than said maximum delay after said initial time.

2. The method according to claim 1, further comprising the step of rejecting said second instruction in response to receiving said second instruction less than a minimum delay after said initial time.

3. The method according to claim 2, wherein a difference between said maximum delay and said minimum delay is approximately a predetermined period.

4. The method according to claim 3, wherein said initial time is determined in units of said predetermined period.

5. The method according to claim 1, further comprising the step of calculating a first new time by adding said initial time and said maximum delay.

6. The method according to claim 5, further comprising the step of calculating a second new time in response to accepting said second instruction proximate said first new time.

7. The method according to claim 6, further comprising the step of rejecting a third of said instructions that depends from said first instruction in response to receiving said third instruction later than said second new time.

8. The method according to claim 1, further comprising the step of rejecting said second instruction in response to a disable signal assigned to said first instruction.

9. The method according to claim 8, further comprising the steps of:

storing a third instruction that is independent of said first instruction in place of said first instruction in response to receiving said third instruction;

calculating a new time in response to receiving said third instruction;

storing said new time indexed by said third instruction; and accepting a repeat instruction of said instructions in response to receiving said repeat instruction proximate said new time.

10. A device comprising:

a detector circuit configured to receive a plurality of instructions; and a timing circuit configured to (i) store a first of said instructions received at an initial time, (ii) calculate a maximum delay as a predetermined multiplication factor times a period of said instructions and (iii) reject a second of said instructions that depends from said first instruction in response to receiving said second instruction greater than said maximum delay after said initial time.

11. The device according to claim 10, wherein said timing circuit is further configured to reject said second instruction in response to receiving said second instruction less than a minimum delay after said initial time.

12. The device according to claim 11, wherein a difference between said maximum delay and said minimum delay is approximately a predetermined period.

13. The device according to claim 12, further comprising a clock circuit configured to generate a time signal in units of said predetermined period.

14. The device according to claim 10, further comprising a memory configured to store a first new time determined by adding said initial time and said maximum delay.

15. The device according to claim 14, wherein said timing circuit is further configured to calculate a second new time in response to acceptance of said second instruction proximate said first new time.

16. The device according to claim 15, wherein said timing circuit is further configured to reject a third of said instructions that depends from said first instruction in response to receiving said third instruction later than said second new time.

17. The device according to claim 10, further comprising a memory configured to store (i) said predetermined multiplication factor and (ii) said period of said instructions.

18. The device according to claim 17, wherein said memory is further configured to store a disable signal assigned to said first instruction to block acceptance of said second instruction.

19. The device comprising:

means for (i) storing a first of a plurality of instructions in response to receiving said first instruction at an initial time and (ii) calculating a maximum delay as a predetermined multiplication factor times a period of said instructions; and means for rejecting a second of said instructions that depends from said first instruction in response to receiving said second instruction greater than said maximum delay after said initial time.

* * * * *